US007625856B2

(12) United States Patent
Burt et al.

(10) Patent No.: US 7,625,856 B2
(45) Date of Patent: Dec. 1, 2009

(54) WATER SOLUBLE SACHET CONTAINING HARD SURFACE CLEANER

(75) Inventors: Diane Joyce Burt, Montvale, NJ (US); Ralph Gencarelli, Montvale, NJ (US); Sophie Strzepek, Montvale, NJ (US)

(73) Assignee: Reckitt Benckiser Inc., Parsippany, NJ (US)

( * ) Notice: Subject to any disclaimer, the term of this patent is extended or adjusted under 35 U.S.C. 154(b) by 279 days.

(21) Appl. No.: 10/525,982

(22) PCT Filed: Aug. 15, 2003

(86) PCT No.: PCT/GB03/03579

§ 371 (c)(1), (2), (4) Date: Mar. 23, 2005

(87) PCT Pub. No.: WO2004/020565

PCT Pub. Date: Mar. 11, 2004

(65) Prior Publication Data

US 2006/0079427 A1 Apr. 13, 2006

(30) Foreign Application Priority Data

Aug. 31, 2002 (GB) ..... 0220295.0

(51) Int. Cl.

| | |
|---|---|
| ***C11D 17/04*** | (2006.01) |
| ***C11D 3/43*** | (2006.01) |
| ***C11D 3/44*** | (2006.01) |
| ***B08B 7/00*** | (2006.01) |

(52) U.S. Cl. ..... 510/439; 510/108; 510/180; 510/220; 510/245; 510/296; 510/505

(58) Field of Classification Search ..... 510/220, 510/296, 439, 108, 180, 245, 505
See application file for complete search history.

(56) References Cited

U.S. PATENT DOCUMENTS

| | | | | |
|---|---|---|---|---|
| 2,974,134 | A | 3/1961 | Pollitzer | 260/209 |
| 3,219,656 | A | 11/1965 | Boettner | 260/210 |
| 3,598,865 | A | 8/1971 | Lew | 260/210 |
| 3,640,998 | A | 2/1972 | Mansfield et al. | 260/210 |
| 3,707,535 | A | 12/1972 | Lew | 260/210 |
| 3,772,269 | A | 11/1973 | Lew | 260/210 |
| 3,839,318 | A | 10/1974 | Mansfield | 260/210 |
| 3,974,138 | A | 8/1976 | Lew | 536/4 |
| 4,223,129 | A | 9/1980 | Roth et al. | 536/4 |
| 4,528,106 | A | 7/1985 | Grolitzer | 252/8.55 |
| 5,888,006 | A | 3/1999 | Ping et al. | 401/137 |
| 5,958,858 | A * | 9/1999 | Bettiol et al. | 510/351 |
| 6,037,319 | A | 3/2000 | Dickler et al. | 510/439 |
| 7,153,816 | B2 * | 12/2006 | Kessler et al. | 510/220 |
| 7,189,686 | B2 * | 3/2007 | Burt et al. | 510/296 |
| 2002/0142931 | A1 * | 10/2002 | DeNome et al. | 510/220 |
| 2004/0063601 | A1 * | 4/2004 | Denome et al. | 510/407 |

FOREIGN PATENT DOCUMENTS

| | | |
|---|---|---|
| DE | 3940123 | 6/1990 |
| EP | A-524721 | 1/1993 |
| EP | 866 115 | 9/1998 |
| GB | A-2244258 | 11/1991 |
| GB | 2376238 | 12/2002 |
| WO | WO 92/17381 | 10/1992 |
| WO | WO 92/17382 | 10/1992 |
| WO | WO 93/08095 | 4/1993 |
| WO | WO 98/42246 | 10/1998 |
| WO | WO 00/27271 | 5/2000 |
| WO | WO 00/55068 | 9/2000 |
| WO | WO 01/22861 | 4/2001 |
| WO | WO 01/72195 | 10/2001 |

* cited by examiner

*Primary Examiner*—Lorna M Douyon
(74) *Attorney, Agent, or Firm*—Norris McLaughlin & Marcus, PA

(57) ABSTRACT

The invention relates to a water-soluble container which contains a composition useful for hard surface cleaning. The composition comprises at least one surfactant selected from non-ionic surfactant, anionic surfactant, and mixtures thereof, at least 70% wt. of at least one organic solvent having a solubility in water of at least 4% wt., optionally at least one alkanolamine; and optionally, conventional additives. The water soluble containers can be made by thermoforming or injection molding.

12 Claims, No Drawings

WATER SOLUBLE SACHET CONTAINING HARD SURFACE CLEANER

The present invention relates to liquid detergent compositions, especially compositions which dissolve and disperse satisfactorily in water.

Liquid detergent compositions comprising surfactants are known. Such compositions can be used, for example, as hard surface cleaners, in either dilutable form or in ready to use form. In general, many surfactant compositions comprise a large amount of water. For example, hand dishwashing compositions often contain up to 80 wt % water. Such compositions do not generally have any compatibility problems when being diluted with a large quantity of water.

For some purposes it is desirable to have detergent compositions which are anhydrous or substantially anhydrous. In some instances, when such compositions are anhydrous or substantially anhydrous, pre-measured doses can be prepared so that the user of the these compositions do not have to measure the appropriate amount of surfactant composition to use every time they wish to clean hard surfaces.

Thus, there is real and continuing need in the art for improved compositions which are useful in the cleaning of surfaces, particularly hard surfaces.

The present composition is especially suitable for use in a water-soluble container where the container is simply added to a large quantity of water and dissolves, releasing its contents. The favorable dissolution and dispersion properties of the composition of the present invention are particularly useful in this context.

Broadly speaking, the present invention also provides a water soluble container containing a hard surface cleaning composition.

In a first aspect, the present invention relates to a water soluble container containing a concentrate composition comprising:

(a) at least one surfactant selected from non-ionic surfactants, anionic surfactants, and mixtures thereof;

(b) at least 70% wt. of at least one organic solvent having a solubility in water of at least 4% wt.;

(c) optionally, but desirably at least one alkanolamine; and (d) optionally, up to about 10% wt. of one or more conventional additives selected from coloring agents, fragrances and fragrance solubilizers, further surfactants, pH adjusting agents and pH buffers, optical brighteners, opacifying agents, hydrotropes, anti-oxidants, and preservatives;

wherein said composition contains no more than 1% wt. water.

In a second aspect, the present invention relates to a water soluble container containing a concentrate composition comprising:

(a) at least one surfactant selected from non-ionic surfactants, anionic surfactants, and mixtures thereof;

(b) at least 70% wt. of at least one organic solvent having a solubility in water of at least 4% wt.;

(c) optionally, but desirably at least one alkanolamine; and (d) optionally, up to about 10% wt. of one or more conventional additives selected from coloring agents, fragrances and fragrance solubilizers, further surfactants, pH adjusting agents and pH buffers, optical brighteners, opacifying agents, hydrotropes, anti-oxidants, and preservatives;

wherein said composition contains no more than 5.5% wt. water.

In a third aspect, the present invention relates to a water soluble container containing a concentrate composition comprising:

(a) at least one surfactant selected from non-ionic surfactants, anionic surfactants, and mixtures thereof;

(b) at least 70% wt. of at least one organic solvent having a solubility in water of at least 4% wt.;

(c) optionally, but desirably at least one alkanolamine; and (d) optionally, up to about 10% wt. of one or more conventional additives selected from coloring agents, fragrances and fragrance solubilizers, further surfactants, pH adjusting agents and pH buffers, optical brighteners, opacifying agents, hydrotropes, anti-oxidants, and preservatives;

wherein said composition contains in excess of 7.5% wt. water, but not more than about 12.5% wt. water.

In a fourth aspect of the invention which is directed to certain particularly preferred compositions of the invention, the inventive compositions according to any of the aforesaid first through third aspects of the invention the concentrate compositions necessarily comprise (c) at least one alkanolamine.

In a fifth and preferred aspect of the invention there is provided a concentrate composition according to any of the first through fourth aspects of the invention recited previously the inventive compositions exhibit a flash point of at least 105° F. or greater. In a sixth and preferred embodiment of the invention there is provided a concentrate composition according to any of the first through fifth aspects of the invention wherein the (b) the at least one organic solvent having a solubility in water of at least 4% wt. is present in an amount of at least 75% wt, preferably of at least 80% wt.

In a sixth and preferred aspect of the invention there is there is provided a concentrate composition according to any of the prior recited inventive aspects wherein (b) at least 70% wt. of at least one organic solvent having a solubility in water of at least 4% wt. comprises (preferably consists essentially of) propylene glycol n-butyl ether and propylene glycol methyl ether and optionally comprises a $C_1$-$C_6$ glycol, or a $C_1$-$C_6$ monohydric alcohol.

In a seventh and preferred aspect of the invention there is there is provided a concentrate composition according to any of the prior recited inventive aspects wherein the (a) at least one surfactant selected from non-ionic surfactants, anionic surfactants, and mixtures thereof comprises (preferably consists essentially of) a $C_{10}$-$C_{14}$alkyl sulfate surfactant, a $C_{10}$-$C_{14}$alkyl ether sulfate surfactant and mixture thereof, further in conjunction with one or more nonionic alkylpolyglycoside surfactants.

In an eighth and further preferred aspect of the invention there is provided a concentrate composition according to any of the prior recited aspects of the invention wherein the (a) at least one surfactant is selected from non-ionic surfactants, anionic surfactants, and mixtures thereof comprises preferably consists essentially of) at least one nonionic surfactant based on an ethoxy/propoxy block copolymer, further in conjunction with at least one nonionic surfactant based on ethoxylated fatty alcohols, and wherein the concentrate composition further includes as a further surfactant an alkoylated quaternary ammonium compound.

A ninth and further aspect of the invention is directed to a water soluble container containing a concentrate composition according to any prior recited inventive aspect wherein the concentrate composition exhibits a flashpoint temperature of at least 105° F.

A tenth and further aspect of the invention is directed to a water soluble container containing a concentrate composition according to any prior recited inventive aspect dissolved in a-larger quantity of water to form a cleaning composition, wherein said cleaning composition exhibits low streaking characteristics when used to clean polished hard surfaces particularly polished metal surfaces, glass and mirrors, particularly mirrors.

A eleventh and further aspect of the invention is directed to a process for treating a surface, particularly a hard surface especially one or more selected from polished metal surfaces, glass and mirrors in need of cleaning, comprising the process steps of:

placing a water soluble container containing a composition according to any of the first through ninth aspects of the invention recited above into a quantity of water;

allowing the water soluble container to dissolve in the water to form a cleaning solution;

and applying an effective amount of the solution to the surface in need of treatment.

These and other aspects of the present invention will become more apparent from the following detailed description.

The water soluble container according to any aspect of the invention can comprise a thermoformed or injection molded water soluble polymer. The water soluble container ; may comprise a thermoformed or injection molded water-soluble polymer. It may also simply comprise a water-soluble film. Such containers are described, for example, in EP-A-524, 721, GB-A-2,244,258, WO 92/17,381 and WO 00/55,068.

The method of thermoforming the water soluble container is preferably one which is similar to the process described in WO 92/17382. According to said process, a first poly (vinyl alcohol) ("PVOH") film is initially thermoformed to produce a non-planar sheet containing a pocket, such as a recess, which is able to retain the aqueous composition. The pocket is generally bounded by a flange, which is preferably substantially planar. The pocket may have internal barrier layers as described in, for example, WO 93/08095. The pocket is then filled with the aqueous composition, and a second PVOH film is placed on the flange and across the pocket. The second PVOH film may or may not be thermoformed. If the first film contains more than one pocket, the second film may be placed across all of the pockets for convenience. The pocket may be completely filled, or only partly filled, for example to leave an air space of from 2 to 20%, especially from 5 to 10%, of the volume of the container immediately after it is formed. Partial filling may reduce the risk of rupture of the container if it is subjected to shock and reduce the risk of leakage if the container is subjected to high temperatures.

The films are then sealed together, for example by heat sealing across the flange. Other methods of sealing the films together may be used, for example infra-red, radio frequency, ultrasonic, laser, solvent, vibration or spin welding. An adhesive such as an aqueous solution of PVOH may also be used. The seal desirably is also water-soluble.

For injection molding the containers of the present invention, the container or capsule generally comprises a receptacle part which holds the composition and a closure part, which may simply close the receptacle part or may itself have at least some receptacle function. The receptacle part preferably has side walls which terminate at their upper end in an outward flange in which the closure part is sealingly secured, especially if the closure part is in the form of a film. The securement may be by means of an adhesive but is preferably achieved by means of a seal, between the flange and the closure part. Heat sealing may be used or other methods such as infra-red, radio frequency, ultrasonic, laser, solvent, vibration or spin welding. An adhesive such as an aqueous solution of PVOH or a cellulose ether may also be used. The seal is desirably also water-soluble.

The closure part may itself be injection molded or blow molded. Preferably, however, it is a plastic film secured over the receptacle part. The film may, for example, comprise PVOH or a cellulose ether such as HPMC or another water-soluble polymer.

The container walls have thicknesses such that the containers are rigid. For example, the outside walls and any inside walls which have been injection molded independently generally have a thickness of greater than 100 μm, for example greater than 150 μm or greater than 200 μm, 300 μm or 500 μm. Preferably, the closure part is of a thinner material than the receptacle part. Thus, typically, the closure part is of thickness in the range 10 to 200 μm, preferably 50 to 100 μm, and the wall thickness of the receptacle part is in the range 300 to 1500 μm, preferably 500 to 1000 μm. The closure part may, however, also have a wall thickness of 300 to 1500 μm, such as 500 to 1000 μm.

Preferably, the closure part dissolves in water (at least to the extent of allowing the washing composition in the receptacle part to be dissolved by the water; and preferably completely) at 20° C. in less than 3 minutes, preferably in less than 1 minute.

The receptacle part and the closure part may be of the same thickness or may be thicker; when thicker the closure part may, for example, be of higher solubility than the receptacle part, in order to dissolve more quickly.

In the manufacturing method, the array, formed by injection molding, is fed to a filling zone, and all the receptacle parts are charged with the washing composition. A sheet of a water-soluble polymer such as PVOH or a cellulose ether may then be secured over the top of the array, to form the closure parts for all the receptacle parts of the array. The array may then be split up into the individual washing capsules, prior to packaging, or it may be left as an array, for packaging, to be split by the user. Preferably, it is left as an array, for the user to break or tear off the individual washing capsules. Preferably, the array has a line of symmetry extending between capsules, and the two halves of the array are folded together, about that line of symmetry, so that closure parts are in face-to-face contact. This helps to protect the closure parts from any damage, between factory and user. It will be appreciated that the closure parts are more prone to damage than the receptacle parts. Alternatively two identical arrays of washing capsules may be placed together with their closure parts in face-to-face contact, for packaging.

In all cases, the polymer is formed into a container or receptacle such as a pouch which can receive the composition, which is filled with the composition and then sealed, for example by heat sealing along the top of the container in vertical form-fill-processes or by laying a further sheet of water-soluble polymer or molded polymer on top of the container and sealing it to the body of the container, for example by heat sealing. Other methods of sealing the films together may be used, for example infra-red, radio frequency, ultrasonic, laser, solvent, vibration or spin welding. An adhesive such as an aqueous solution of PVOH may also be used. The seal desirably is also water-soluble.

Desirably the water-soluble polymer is PVOH. The PVOH may be partially or fully alcoholized or hydrolyzed. For example, it may be from 40 to 100% preferably 70 to 92%, more preferably about 88%, alcoholized or hydrolyzed, polyvinyl acetate. When the polymer is in film form, the film may be cast, blown or extruded.

The water-soluble polymer is generally cold water (20° C) soluble, but depending on its chemical nature, for example the degree of hydrolysis of the PVOH, may be insoluble in cold water at 20° C., and only become soluble in warm water or hot water having a temperature of, for example, 30° C., 40° C., 50° C. or even 60° C. It is preferable that the water soluble polymer is soluble in cold water.

The water soluble containers of the present invention find particular use where a unit-dosage form of the composition is required which is then diluted prior to use. Thus, for example, the composition may be useful as a hard surface cleaner (for example, floors, bathroom surfaces, windows) which is diluted prior to use. The water soluble container to be used for hard surface cleaners can take any shape, such as an envelope, sachet, sphere, cylinder, cube or cuboid (i.e. a rectangular parallelepiped whose faces are not all equal) where the base is square, circular, triangular, or oval, but water soluble containers of rounded cuboid or cylindrical shape are preferred; rounded cuboid for use in, for example, a bucket of water and cylindrical when used as a refill for a trigger bottle. For the rounded cuboid water soluble container, the water soluble container can have dimensions such as, for example, having a length of 1 to 5 cm, especially 3.5 to 4.5 cm, a width of 1.5 to 3.5 cm, especially 2 to 3 cm, and a height of 1 to 2 cm, especially 1.25 to 1.75 cm. The water-soluble container may hold, for example, from 10 to 40 g of the composition, especially from 10 to 25 g of the composition of the present composition. For the cylindrical shape, the water soluble container diameter should be such that the water soluble container fits through the opening of a trigger bottle, generally about 2 cm. The length of the water soluble container can be about 1 to 8 cm. Such water soluble containers hold about 3 to about 25 g of composition. However, it should be understood that there is no theoretical limitation, in either size or shape, and what is suitable will normally be decided upon the basis of the "dose" of the water soluble container's contents, the size of any aperture the water soluble container may have to pass through, and the available means of delivery.

In some embodiments, a single layer film for both the top and bottom the packet can be used or a laminate film of two or more layers of PVOH or other water soluble film can be used on either the top or bottom or on both top and bottom of the packet. For the cylindrical container, the film can also be single layer or a laminate of two or more layers of PVOH or other water soluble film.

With reference now to the compositions used in conjunction with the water soluble containers to form articles according to the invention, said compositions necessarily comprise (a) at least one surfactant selected from non-ionic surfactant, anionic surfactant, and mixtures thereof.

Nonlimiting examples of suitable non-ionic surfactants which may be used in the present invention are as follows:

(1) The polyethylene oxide condensates of alkyl phenols. These compounds include the condensation products of alkyl phenols having an alkyl group containing from about 6 to 12 carbon atoms in either a straight chain or branched chain configuration with ethylene oxide, the ethylene oxide being present in an amount equal to 5 to 25 moles of ethylene oxide per mole of alkyl phenol. The alkyl substituent in such compounds can be derived, for example, from polymerized propylene, diisobutylene and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol and diisooctyl phenol condensed with about 15 moles of ethylene oxide per mole of phenol.

(2) The condensation products of aliphatic alcohols with from about 1 to about 60 moles of ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 14 carbon atoms). One example of such a non-ionic surfactant is available as Empilan KM 50.

(3) Alkoxy block copolymers, and in particular, compounds based on ethoxy/propoxy block copolymers. Polymeric alkylene oxide block copolymers include non-ionic surfactants in which the major portion of the molecule is made up of block polymeric $C_2$-$C_4$ alkylene oxides. Such non-ionic surfactants, while preferably built up from an alkylene oxide chain starting group, and can have as a starting nucleus almost any active hydrogen containing group including, without limitation, amides, phenols, thiols and secondary alcohols.

Other non-ionic surfactants containing the characteristic alkylene oxide blocks are those which may be generally represented by the formula (A):

$$HO—(EO)_x(PO)_y(EO)_z—H \quad (A)$$

where EO represents ethylene oxide,

PO represents propylene oxide, y equals at least 15, $(EO)_{x+y}$ equals 20 to 50% of the total weight of said compounds, and, the total molecular weight is preferably in the range of about 2000 to 15,000. These surfactants are available under the PLURONIC tradename from BASF or EMULGEN from Kao.

Another group of non-ionic surfactants can be represented by the formula (B):

$$R\text{-}(EO,PO)_a(EO,PO)_b—H \quad (B)$$

wherein R is an alkyl, aryl or aralkyl group, where the R group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further non-ionic surfactants which in general are encompassed by Formula B include butoxy derivatives of propylene oxide/ethylene oxide block polymers having molecular weights within the range of about 2000-5000.

Still further non-ionic surfactants containing polymeric butoxy (BO) groups can be represented by formula (C) as follows:

$$RO—(BO)_n(EO)_x—H \quad (C)$$

wherein R is an alkyl group containing I to 20 carbon atoms, n is about 5-15 and x is about 5-15.

Also further non-ionic block copolymer surfactants, which also include polymeric butoxy groups, are those which may be represented by the following formula (D):

$$HO—(EO)_x(BO)_n(EO)_y—H \quad (D)$$

wherein n is about 5-15, preferably about 15, x is about 5-15, preferably about 15, and y is about 5-15, preferably about 15.

Still further non-ionic block copolymer surfactants include ethoxylated derivatives of propoxylated ethylene diamine, which may be represented by the following formula:

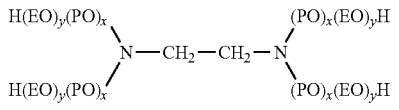

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

Further examples of non-ionic surfactants include Exemplary polyoxyalkylene alkylethers may be represented by the following structures:

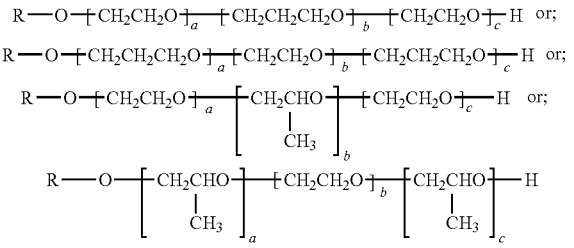

wherein:

R is a $C_{8-20}$ group, which may be straight chained or branched, but is preferably a $C_{8-16}$ group, and most preferably is a $C_{12-14}$ alkyl group;

a+b+c are intergers whose sum is in the range of from 8-18 with the proviso that a, b and c are each at least 1.

Desirably the polyoxyalkylene alkylethers are those which have a molecular weight in the range of from about 200 to about 2000, more prefeably have a molecular weight in the range of 500-1100.

Such polyoxyalkylene alkylethers as depicated above are presently commercially available as EMULGEN polyoxyalkylene alkylethers (ex. KAO Group, Japan) Particularly useful and particularly preferred examples of such polyoxyalkylene alkylethers include EMULGEN MS-110 which is described with reference to the Examples, discussed below.

Still further examples of non-ionic surfactants include linear alcohol ethoxylates. The linear alcohol ethoxylates which may be employed in the present invention are generally include the $C_6$-$C_{15}$ straight chain alcohols which are ethoxylated with about 1 to 13 moles of ethylene oxide. Examples of such include Alfonic® 810-4.5, which is described in product literature from Sasol North America Inc. as having an average molecular weight of 356, an ethylene oxide content of about 4.85 moles (about 60 wt. %), and an HLB of about 12; Alfonic® 810-2, which is described in product literature from Sasol North America Inc. as having an average molecular weight of 242, an ethylene oxide content of about 2.1 moles (about 40 wt. %), and an HLB of about 12; and Alfonic® 610-3.5, which is described in product literature from Sasol North America Inc. as having an average molecular weight of 276, an ethylene oxide content of about 3.1 moles (about 50 wt. %), and an HLB of 10. Product literature from Sasol North America Inc. also identifies that the numbers in the alcohol ethoxylate name designate the carbon chain length (numbers before the hyphen) and the average moles of ethylene oxide (numbers after the hyphen) in the product. These examples are typically $C_6$-$C_{11}$ straight-chain alcohols which are ethoxylated with from about 3 to about 6 moles of ethylene oxide. Other examples of ethoxylated alcohols include the Neodol® 91 series non-ionic surfactants available from Shell Chemical Company which are described as $C_9$-$C_{11}$ ethoxylated alcohols. The Neodol® 91 series non-ionic surfactants of interest include Neodol 91-2.5, Neodol 91-6, and Neodol 91-8. Neodol 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Still further examples of ethoxylated alcohols include the Rhodasurf® DA series non-ionic surfactants available from Rhodia which are described to be branched isodecyl alcohol ethoxylates. Rhodasurf DA-530 has been described as having 4 moles of ethoxylation and an HLB of 10.5; Rhodasurf DA-630 has been described as having 6 moles of ethoxylation with an HLB of 12.5; and Rhodasurf DA-639 is a 90% solution of DA-630. Yet further examples of ethoxylated alcohols include those from Tomah Products (Milton, Wisc.) under the Tomadol tradename with the formula $RO(CH_2CH_2O)_nH$ where R is the primary linear alcohol and n is the total number of moles of ethylene oxide. The ethoxylated alcohol series from Tomah include 91-2.5; 91-6; 91-8—where R is linear $C_9/C_{10}/C_{11}$ and n is 2.5, 6, or 8; 1-3; 1-5; 1-7; 1-73B; 1-9;—where R is linear $C_{11}$ and n is 3, 5, 7 or 9; 23-1; 23-3; 23-5; 23-6.5—where R is linear $C_{12}/C_{13}$ and n is 1, 3, 5, or 6.5; 25-3; 25-7; 25-9; 25-12—where R is linear $C_{12}/C_{13}/C_{14}/C_{15}$ and n is 3, 7, 9, or 12; and 45-7; 45-13—where R is linear $C_{14}/C_{15}$ and n is 7 or 13

A further useful class of non-ionic surfactants include those based on amine oxide compounds. Examples of amine oxide compounds may be defined as one or more of the following of the four general classes:

(1) Alkyl di (lower alkyl) amine oxides in which the alkyl group has about 6-24, and preferably 8-18 carbon atoms, and can be straight or branched chain, saturated or unsaturated. The lower alkyl groups include between 1 and 7 carbon atoms, but preferably each include 1-3 carbon atoms. Examples include octyl dimethyl amine oxide, lauryl dimethyl amine oxide, myristyl dimethyl amine oxide, and those in which the alkyl group is a mixture of different amine oxides, such as dimethyl cocoamine oxide, dimethyl (hydrogenated tallow) amine oxide, and myristyl/palmityl dimethyl amine oxide;

(2) Alkyl di (hydroxy lower alkyl) amine oxides in which the alkyl group has about 6-22, and preferably 8-18 carbon atoms, and can be straight or branched chain, saturated or unsaturated. Examples include bis-(2-hydroxyethyl) cocoamine oxide, bis-(2-hydroxyethyl) tallowamine oxide; and bis-(2-hydroxyethyl) stearylamine oxide;

(3) Alkylamidopropyl di(lower alkyl) amine oxides in which the alkyl group has about 10-20, and preferably 12-16 carbon atoms, and can be straight or branched chain, saturated or unsaturated. Examples are cocoamidopropyl dimethyl amine oxide and tallowamidopropyl dimethyl amine oxide; and (4) Alkylmorpholine oxides in which the alkyl group has about 10-20, and preferably 12-16 carbon atoms, and can be straight or branched chain, saturated or unsaturated.

Two or more amine oxides may be used, wherein amine oxides of varying chains of the $R_2$ group are present. Examples of amine oxide compounds include N-alkyl dimethyl amine oxides, particularly octyl dimethyl amine oxides as well as lauryl dimethyl amine oxide. These amine oxide compounds are available as surfactants from McIntyre Group Ltd. under the tradename Mackamine® as well as from Stepan Co., under the tradename Ammonyx®.

A further nonionic surfactant which may be used in the inventive compositions include alkyl polyglycosides. Suitable alkyl polyglycosides are known nonionic surfactants which are alkaline and electrolyte stable. Alkyl mono and polyglycosides are prepared generally by reacting a monosaccharide, or a compound hydrolyzable to a monosaccharide with an alcohol such as a fatty alcohol in an acid-medium. Various glycoside and polyglycoside compounds including alkoxylated glycosides and processes for making them are disclosed in U.S. Pat. No. 2,974,134; U.S. Pat. No.3,219,656; U.S. Pat. No. 3,598,865; U.S. Pat. No. 3,640,998; U.S. Pat. No. 3,707,535; U.S. Pat. No. 3,772,269; U.S. Pat. No. 3,839,318; U.S. Pat. No. 3,974,138; U.S. Pat. No. 4,223,129; and U.S. Pat. No. 4,528,106.

A preferred group of alkyl glycoside surfactants suitable for use in the practice of this invention may be represented by formula I below:

$$RO—(R_1O)_y\text{-}(G)_xZ_b \qquad \text{I}$$

wherein:

R is a monovalent organic radical containing from about 6 to about 30, preferably from about 8 to about 18 carbon atoms;

$R_1$ is a divalent hydrocarbon radical containing from about 2 to about 4 carbon atoms;

O is an oxygen atom;

y is a number which has an average value from about 0 to about 1 and is preferably 0;

G is a moiety derived from a reducing saccharide containing 5 or 6 carbon atoms; and x is a number having an average value from about 1 to 5 (preferably from 1.1 to 2);

Z is $O_2M^1$,

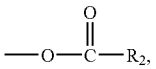

$O(CH_2)$, $CO_2M^1$, $OSO_3M^1$, or $O(CH_2)SO_3M^1$; $R_2$ is $(CH_2)CO_2M^1$ or $CH{=}CHCO_2M^1$; (with the proviso that Z can be $O_2M^1$ only if Z is in place of a primary hydroxyl group in which the primary hydroxyl-bearing carbon atom, $—CH_2OH$, is oxidized to form a

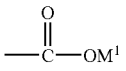

group);

b is a number of from 0 to 3x+1 preferably an average of from 0.5 to 2 per glycosal group;

p is 1 to 10, $M^1$ is $H^+$ or an organic or inorganic cation, such as, for example, an alkali metal, ammonium, monoethanolamine, or calcium.

As defined in Formula I above, R is generally the residue of a fatty alcohol having from about 8 to 30 and preferably 8 to 18 carbon atoms. Examples of such alkylglycosides as described above include, for example, APG™ 325 CS which is described as being a 50% $C_9$-$C_{11}$ alkyl polyglycoside, also commonly referred to as D-glucopyranoside, (commercially available from Henkel Corp, Ambler Pa.) and Glucopon® 625 CS which is described as being a 50% $C_{10}$-$C_{16}$ alkyl polyglycoside, also commonly referred to as a D-glucopyranoside, (available from Henkel Corp., Ambler Pa.), as well as other materials sold under the Glucopon® tradename.

Non limiting examples of anionic surfactants which may be included in the concentrate compositions include for example, alkali metal salts, ammonium salts, amine salts, or aminoalcohol salts of one or more of the following compounds (linear and secondary): alcohol sulfates and sulfonates, alcohol phosphates and phosphonates, alkyl sulfates, alkyl ether sulfates, sulfate esters of an alkylphenoxy polyoxyethylene ethanol, alkyl monoglyceride sulfates, alkyl sulfonates, olefin sulfonates, paraffin sulfonates, beta-alkoxy alkane sulfonates, alkylamidoether sulfates, alkylaryl polyether sulfates, monoglyceride sulfates, alkyl ether sulfonates, ethoxylated alkyl sulfonates, alkylaryl sulfonates, alkyl benzene sulfonates, alkylamide sulfonates, alkyl monoglyceride sulfonates, alkyl carboxylates, alkyl sulfoacetates, alkyl ether carboxylates, alkyl alkoxy carboxylates having 1 to 5 moles of ethylene oxide, alkyl sulfosuccinates, alkyl ether. sulfosuccinates, alkylamide sulfosuccinates, alkyl sulfosuccinamates, octoxynol or nonoxynol phosphates, alkyl phosphates, alkyl ether phosphates, taurates, N-acyl taurates, fatty taurides, fatty acid amide polyoxyethylene sulfates, isethionates, acyl isethionates, and sarcosinates, acyl sarcosinates, or mixtures thereof. Generally, the alkyl or acyl radical in these various compounds comprise a carbon chain containing 12 to 20 carbon atoms.

Exemplary useful anionic surfactants include diphenyl disulfonates and alkyl diphenyl ether disulfonates, including those which are commercially available in anionic surfactant compositions from the Dow Chemical Co. These are available as DOWFAX materials of which those which conform to the following general structure are particularly useful:

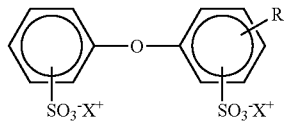

wherein:

X represents a counterion, desirably an alkali metal or ammonium counterion, yet more desirably is lithium, potassium or sodium, especially sodium, and, R represents a hydrogen of a hydrophobic alkyl group, desirably a linear or branched $C_6$-$C_{16}$ alkyl group which may be straight chained or branched, may be optionally substituted but desirably are unsubstituted $C_6$-$C_{12}$ straight chained alpha olefins, or is tetrapropylene.

Of these, particularly useful are those available as DOWFAX 3B2 which is described as being a sodium salt according to the general structure depicted above and wherein R is a $C_6$ olefin; and, DOWFAX 2A1 which is described as being a sodium salt according to the general structure depicted above and wherein R is tetrapropylene.

Examples of the foregoing anionic surfactants are available under the following tradenames: RHODAPON, STEPANOL, HOSTAPUR, SURFINE, SANDOPAN, NEODOX, BIOSOFT, and AVANEL.

The (a) at least one surfactant selected from non-ionic surfactant, anionic surfactant, and mixtures thereof is present in the concentrate compositions in an amount of from about 0.01 to about 20% wt, preferably from about 0.01-10% wt.

Particularly preferred weight ranges, as well -as particularly preferred surfactant(s) are described with reference to the Examples.

According to one particularly preferred aspect of the invention, the concentrate composition comprises (a) at least one surfactant selected from non-ionic surfactants, anionic surfactants, and mixtures thereof which comprises (preferably consists essentially of) a $C_{10}$-$C_{14}$alkyl sulfate surfactant, a $C_{10}$-$C_{14}$alkyl ether sulfate surfactant and mixture thereof, further in conjunction with one or more nonionic alkylpolyglycoside surfactants. Most preferably the a $C_{10}$-$C_{14}$alkyl sulfate surfactant is sodium lauryl sulfate, the a $C_{10}$-$C_{14}$alkyl ether sulfate surfactant is sodium lauryl ether sulfate both of which are present in conjunction with at least one nonionic alkylpolyglycoside surfactant. The inclusion of nonionic alkylpolyglycoside surfactants has been surprisingly observed by the inventors to provide not only a good cleaning effect but have also been observed to function as low streaking surfactants and to provide excellent surface wettability thereby providing excellent distribution of the concentrate compositions, and especially cleaning compositions formed from aqueous dilutions of the concentrate compositions, onto hard surfaces being treated.

According to a further particularly preferred aspect of the invention, the concentrate composition comprises (a) at least one surfactant is selected from non-ionic surfactants, anionic surfactants, and mixtures thereof comprises (preferably consists essentially of) at least one nonionic surfactant based on an ethoxy/propoxy block copolymer, further in conjunction with at least one nonionic surfactant based on ethoxylated fatty alcohols, and wherein the concentrate composition further includes as a further surfactant an alkoylated quaternary ammonium compound. The present inventors have observed that the combination of this preferred system of surfactants also provides concentrate compositions which have been observed by the inventors to provide not only a good cleaning effect but have also been observed to function as low streaking surfactants and to provide excellent surface wettability thereby providing excellent distribution of the concentrate compositions, and especially cleaning compositions formed from aqueous dilutions of the concentrate compositions, onto hard surfaces being treated.

The concentrate compositions of the present invention necessarily also comprise (b) at least 70% wt. of at least one organic solvent having a solubility in water of at least 4% wt. Examples of organic solvents which may be included in the concentrate compositions include those which are at least partially water-miscible such as alcohols (e.g., low molecular weight alcohols, such as, for example, ethanol, propanol, isopropanol, and the like), glycols (such as, for example, ethylene glycol, propylene glycol, hexylene glycol, and the like), water-miscible ethers (e.g. diethylene glycol diethylether, diethylene glycol dimethylether, propylene glycol dimethylether), water-miscible glycol ether (e.g. propylene glycol monomethylether, propylene glycol mono ethylether, propylene glycol monopropylether, propylene glycol monobutylether, ethylene glycol monobutylether, dipropylene glycol monomethylether, diethyleneglycol monobutylether), lower esters of monoalkylethers of ethylene glycol or propylene glycol (e.g. propylene glycol monomethyl ether acetate) all commercially available from Dow Chemical Co. (Midland, Mich.). Mixtures of several organic solvents can also be used. Preferred for use as solvents in this invention are the glycol ethers having the general structure $R_a$—$R_b$—OH, wherein $R_a$ is an alkoxy of 1 to 20 carbon atoms, or aryloxy of at least 6 carbon atoms, and $R_b$ is an ether condensate of propylene glycol and/or ethylene glycol having from one to ten glycol monomer units. Preferred are glycol ethers having one to five glycol monomer units. These are $C_3$-$C_{20}$ glycol ethers. Examples of more preferred solvents include propylene glycol methyl ether, dipropylene glycol methyl ether, tripropylene glycol methyl ether, propylene glycol isobutyl ether, ethylene glycol methyl ether, ethylene glycol ethyl ether, ethylene glycol butyl ether, diethylene glycol phenyl ether, propylene glycol phenol ether, and mixtures thereof. Desirably the (b) at least one organic solvent having a solubility in water of at least 4% wt comprises (preferably consists essentially of) propylene glycol n-butyl ether and propylene glycol methyl ether and further optionally comprises a $C_1$-$C_6$ glycol, or a $C_1$-$C_6$ monohydric alcohol, although in certain preferred compositions $C_1$-$C_6$ glycols and $C_1$-$C_6$ monohydric alcohols are omitted.

Desirably the selection of the (b) at least one organic solvent having a solubility in water of at least 4% wt in the a concentrate composition is such that the overall concentrate composition exhibits a flashpoint temperature of at least 105° F., preferably of at least 110° F. and especially of at least 115° F. The inventors have found that a minimum flashpoint temperature of at least 105° F. provides a composition which provides good cleaning and evaporative characteristics, particularly low streaking compositions which may also be safely packaged and handled prior to use in forming a cleaning composition by adding an aliquot of the concentrate composition to a larger quantity of water. Higher flashpoint temperatures are generally to be preferred.

The present inventors have found that the presence of both propylene glycol n-butyl ether with propylene glycol methyl ether, desirably in a respective weight ratios range of 0.5-2:2-0.5 of propylene glycol n-butyl ether:propylene glycol methyl ether, especially in a respective weight ratios range of 0.8-1.2:1.2-0.8 provides excellent stability of the concentrate composition packaged in the water soluble containers taught hererin especially storage under elevated temperatures which approximate long shelf life storage characteristics.

The further presence of $C_1$-$C_6$ glycols and $C_1$-$C_6$ monohydric alcohols and in particular $C_1$-$C_4$ monohydric alcohols especially isopropanol may be desired in aspects of the invention wherein the concentrate compositions comprise about 2% or more water. The present inventors have found that the inclusion of a minor amount of $C_1$-$C_6$ glycols and $C_1$-$C_6$ monohydric alcohols may provide a useful cleaning benefit, however care is to be taken so that they are not included in the concentrate compositions in amounts which will decrease the flashpoint temperature to below about 105° F. While not wishing to be bound by the following, the inventors have observed that in concentrate composition having low amounts of water, e.g., 2% wt. water or less, the inclusion of significant amounts of $C_1$-$C_6$ glycols and $C_1$-$C_6$ monohydric alcohols in concentrate compositions which include little or no water is desirably to be avoided as they have been observed to deleteriously affect PVOH films which may be used. However, with increasing amounts of water present in the concentrate compositiosn, specifically to about 12.5% wt. the total amount of $C_1$-$C_6$ glycols and $C_1$-$C_6$ monohydric alcohols may be present to amounts of about 5% wt. of the concentrate compositions. Desirably however total amount of $C_1$-$C_6$ glycols and $C_1$-$C_6$ monohydric alcohols is not more than 5% wt. of the concentrate compositions, more desirably is not more than about 2.5% wt.

The (b) the at least one organic solvent having a solubility in water of at least 4% wt. is necessarily present in an amount of 70% wt. of the concentrate composition of which it forms a part, but desirably present in an amount of at least 75% wt, more preferably in amounts of at least 80% wt.

Particularly preferred weight ranges, as well as the identity of particularly preferred organic solvents and combinations thereof are described with reference to the Examples.

A further optional constituent, but in certain particularly preferred embodiments, necessary constituent of the present invention are (c) at least one alkanolamine. Exemplary useful include monoalkanolamines, dialkanolamines, trialkanolamines, and alkylalkanolamines such as alkyl-dialkanolamines, and dialkyl-monoalkanolamines. The alkanol and alkyl groups are generally short to medium chain length, that is, from 1 to 7 carbons in length. For di- and trialkanolamines and dialkyl-monoalkanolamines, these groups can be combined on the same amine to produce for example, methylethylhydroxypropylhydroxylamine. The alkanolamine constituent comprises from 0.01 to about 10.0% wt. of the inventive compositions. Desirably the alkanolamine constituent is included in a sufficient and effective amount such that the pH of the concentrate compositions are at least about 7.5 or greater, preferably at least about 10 and most preferably are in a range of about 10-12. Further desirably the alkanolamine constituent is included in a sufficient and effective amount such that the pH of the diluted concentrate compositions used as cleaning compositions are at least about 7.5 or greater, preferably at least about 8.5 and most preferably are at least about 10. Particularly preferred weight ranges, as well as the identity of particularly preferred alkanolamines are described with reference to the Examples.

The inventors have found that the use of alkanolamines which are volatile organic materials are preferred for use to adjust the alkalinity of both the concentrate compositions as well as the cleaning compositions over inorganic salts and other inorganic materials which are commonly known useful as pH adjusting agents as such inorganic materials typically are non-volatile and are prone to leaving deposits upon hard surfaces which may contributed to undesired levels of streaking of polished hard surfaces, glass, mirrors and the like. Desirably such pH adjusting agents based on inorganic materials are absent from the present inventive compositions.

The inventive compositions may optionally further comprise (d) up to about up to about 10% wt. of one or more conventional additives selected from coloring agents, fragrances and fragrance solubilizers, further surfactants, pH adjusting agents and pH buffers, optical brighteners,.opacifying agents, hydrotropes, anti-oxidants, and preservatives. Such further conventional additives are per se, known to the art and are widely commercially available. When one or more of the optional constituents is added, i.e., fragrance and/or coloring agents, the esthetic and consumer appeal of the product is often favorably improved. The use and selection of these optional constituents is well known to those of ordinary skill in the art, and they should be selected so as to not deleteriously interfere with-the function of one or more of the other constituents present in the inventive compositions. Such materials are described, for example in *McCutcheon 's Detergents and Emulsifiers*, Vol. 1, North American Edition, 1991; as well as in *McCutcheon 's Functional Materials*, Vol. 2, North American Edition, 1991, the contents of which are herein incorporated by reference. Particularly preferred weight ranges, as well as the identity of particularly preferred optional constituents are described with reference to the Examples.

A further class of surfactant which may be advantageously present in the inventive compositions are alkoxylated quaternary ammonium compounds include those which may be represented by the general structure:

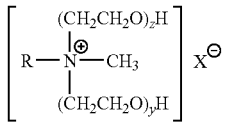

wherein: R is a $C_8$-$C_{24}$ alkyl group;

z+y are individually integer values of from 1-14, inclusive, but are most preferably selected to that z+y=2-15, and in certain particularly preferred embodiments z+y=2 or 15;

X may be any counterion, but is desirably Cl or $NO_3$.

Exemplary materials include ETHOQUAD 18/12 described to be octadecylmethyl [ethoxylated (2)]-ammonium chloride; ETHOQUAD 18/25 described to be octadecyl methyl [ethoxylated (15)] ammonium chloride, ETHOQUAD C/25 described to be coco methyl [ethoxylated (15)] ammonium chloride, ETHOQUAD C/12 described to be coco methyl [ethoxylated (2)] ammonium chloride, ETHOQUAD C/12 Nitrate described to be coco methyl [ethoxylated (2)] ammonium nitrate, ETHOQUAD O/25 described to be oleyl methyl [ethoxylated (15)] ammonium chloride, ETHOQUAD O/12 described to be oleyl methyl [ethoxylated (2)] ammonium chloride, as well as ETHOQUAD T/12 described to be tallow alkyl methyl [ethoxylated (2)] ammonium chloride.

Further exemplary materials include Q-18-15 described to be octadecyl poly(15)oxyethylene methyl ammonium chloride and Q-C-15 described to be coco poly(15)oxyethylene methyl ammonium chloride (both of which are available from Tomah Inc.), as well as VARIQUAT K-1215, a methyl bis-(polyethoxy ethanol) coco ammonium chloride, with an 15 ethoxy groups; ADOGEN 66, an ethyl bis-(polyethoxy ethanol) tallow ammonium chloride, having 15 ethoxy groups, VARISOFT 5TD, an ethoxylated di (C12-C18) alkyl methyl ammonium chloride, with 5 ethoxy groups, REWOQUAT CPEM, a coco pentaethoxy methyl ammonium methosulfate, with 5 ethoxy groups. Particularly preferred alkoxylated quaternary ammonium compounds which may be included in the concentrate compositions of the invention include those which are presently commercially available preparations identified as REWOQUAT CQ-100 which is described by its supplier to be mixture of ethoxylated cocoalkyl methyl quaternary ammonium chlorides and ethoxylated fatty alcohols. As noted with reference to the eighth and preferred embodiment of concentrate compositions the inclusion of this material is particularly preferred as the present inventors have found that the inclusion of such a surfactant provides excellent surface wettability, a good cleaning effect and low streaking. Such beneficial properties have been observed when the REWOQUAT CQ-100 is used in conjunction with a nonionic surfactant constituent based on polyoxylakylene alkyl ethers, e.g., EMULGEN MS-100 as described with reference to one or more of the Examples.

A yet further class of surfactant which may be advantageously present in the inventive compositions are fluorosurfacant compositions selected from the group of nonionic fluorosurfactants, cationic fluorosurfactants, and mixtures thereof which are soluble in the aqueous compositions being taught herein, particularly compositions which do not include further detersive surfactants, or further organic solvents, or both. Particularly useful nonionic fluorosurfactant compounds are found among the materials presently commercially marketed under the tradename FLUORAD (ex. 3M Corp.)

An especially useful nonionic fluorosurfactant compounds include those which is believed to conform to the following formulation:

$$C_nF_{2n+1}SO_2N(C_2H_5)(CH_2CH_2O)_xCH_3$$

wherein: n has a value of from 1-12, preferably from 4-12, most preferably 8;

x has a value of from 4-18, preferably from 4-10, most preferably 7;

which is described to be a nonionic fluorinated alkyl alkoxylate and which is sold as FLUORAD® FC-171 (ex. 3M Corp., formerly Minnesota Mining and Manufacturing Co.).

Exemplary useful fluorosurfactants include those sold as Fluorad® FC-740, generally described to be fluorinated alkyl esters; Fluorad® FC-430, generally described to be fluorinated alkyl esters; Fluorad® FC-431, generally described to be fluorinated alkyl esters; and, Fluorad® FC-170-C, which is generally described as being fluorinated alkyl polyoxyethylene ethanols.

Additionally particularly useful nonionic fluorosurfactant compounds are also found among the materials marketed under the tradename ZONYL® (DuPont Performance Chemicals). These include, for example, ZONYL® FSO and ZONYL® FSN. These compounds have the following formula:

$$RfCH_2CH_2O(CH_2CH_2O)_xH$$

where Rf is $F(CF_2CF_2)_y$. For ZONYL® FSO, x is 0 to about 15 and y is 1 to about 7. For ZONYL® FSN, x is 0 to about 25 and y is 1 to about 9.

An example of a useful cationic fluorosurfactant compound has the following structure:

$$C_nF_{2n+1}SO_2NHC_3H_6N{+}(CH_3)_3I^-$$

where n~8. This cationic fluorosurfactant is available under the tradename Fluorad FC-135 from 3M.

Another example of a useful cationic fluorosurfactant is $$F_3{-}(CF_2)_n{-}(CH_2)_mSCH_2CHOH{-}CH_2{-}N^+R_1R_2R_3Cl^-$$

where n is 5-9 and m is 2, and $R_1$, $R_2$ and $R_3$ are —CH3. This cationic fluorosurfactant is available under the tradename ZONYL® FSD (available from DuPont, described as 2-hydroxy-3-((gamma-omega-perfluoro-C6-20-alkyl)thio)-N,N,N-trimethyl-1-propyl-ammonium chloride).

Other cationic fluorosurfactants suitable for use in the present invention are also described in EP 866 115.

Exemplary useful hydrotropes useful in the use of the compositions of the present invention include known art hydrotrope compositions. Suitable hydrotropes include salts of aryul sulfonic acids such as naphtyl and benzene sulfonic acids, wherein the aromatic nucleus may be unsubstituted or substituted with lower alkyl groups, such as C1-4 alkyl groups, especially methyl, ethyl and/or isopropyl groups. Up to three of such substitutents may be present in the aromatic nucleus, but preferably zero to two are preferred. The salt forming cation of the hydrotrope is preferably an alkali metal such as sodium or potassium, especially sodium. Howver, other water soluble cations such as ammonium, mono-, di- and tri- lower alkyl, i.e., C1-4 alkanol ammonium groups can be used in the place of the alkali metal cations. Exemplary hydrotropes include benzene sulfonates, o-toluene sulfonates, m-toluene sulfonates, and p-toluene sulfonates; 2,3-xylene sulfonates, 2,4-xylene sulfonates, and 4,6-xylene sulfonates; cumene sulfonates, toluene sulfonates, wherein such exemplary hydrotropes are generally in a salt form thereof, including sodium and potassium salt forms. Further exemplary hydrotropes include lower alkyl sulfate salts, particularly those having from about one to six carbon atoms in the alkyl group.

Exemplary useful preservatives include compositions which comprise parabens, including methyl parabens and ethyl parabens, glutaraldehyde, formaldehyde, 2-bromo-2-nitropropoane-1,3-diol, 5-chloro-2-methyl-4-isothiazolin-3-one, 2-methyl-4-isothiazoline-3-one, and mixtures thereof. One exemplary composition is a combination 5-chloro-2-methyl-4-isothiazolin-3-one and 2-methyl-4-isothiazolin-3-one where the amount of either component may be present in the mixture anywhere from 0.001 to 99.99 weight percent, based on the total amount of the preservative. For reasons of availability, the most preferred preservative are those commercially available preservative comprising a mixture of 5-chloro-2-methyl-4-isothiazolin-3-one and 2-methyl-4-isothiazolin-3-one marketed under the trademark KATHON® CG/ICP as a preservative composition presently commercially available from Rohm and Haas (Philadelphia, Pa.). Further useful preservative compositions include KATHON® CG/ICP II, a further preservative composition presently commercially available from Rohm and Haas (Philadelphia, Pa.), PROXEL® which is presently commercially available from Zeneca Biocides (Wilmington, Del.), SUTTOCIDE® A which is presently commercially available from Sutton Laboratories (Chatam, N.J.) as well as TEXTAMER® 38AD which is presently commercially available from Calgon Corp. (Pittsburgh, Pa.).

The compositions according to the invention are useful in the cleaning of surfaces, especially hard surfaces in need of such treatment. In accordance with the present inventive process, cleaning of such surfaces comprises the steps of placing one or more water soluble containers which contains a composition of the present invention into a container containing an amount of water (for example, spray bottle with dip tube, a bucket) and allowing the container to dissolve, and then applying an effective amount of a composition as taught herein, by sponging, mopping, scrubbing, or spraying, to such surface in need of treatment. Afterwards, the compositions are optionally but desirably wiped, scrubbed or otherwise physically contacted with the hard surface, and further optionally, may be subsequently rinsed from the surface.

By way of example, hard surfaces include surfaces composed of refractory materials such as: glazed and unglazed tile, porcelain, ceramics as well as stone including marble, granite, and other stones surfaces; glass; mirrors; metals; plastics e.g. polyester, vinyl; fiberglass, Formica®, Corian® and other hard surfaces known to the industry. Hard surfaces which are to be particularly denoted are lavatory fixtures such as shower stalls, bathtubs and bathing appliances (racks, shower doors, shower bars) toilets, bidets, wall and flooring surfaces especially those which include refractory materials and the like. Particularly preferred embodiments of the invention are directed to a water soluble container containing a concentrate composition according to any prior recited inventive aspect dissolved in a larger quantity of water to form a cleaning composition, wherein said cleaning composition exhibits low streaking characteristics when used to clean polished hard surfaces particularly polished metal surfaces, glass and mirrors, particularly mirrors.

As noted previously, preferred compositions useful in conjunction with the water soluble containers of the invention may be produced with various amounts of water. According to certain preferred aspects of the invention the total amount of water in the compositions is no more than 1% wt. According to certain further preferred aspects of the invention the total amount of water is no more than 5.5% wt. In still further preferred aspects of the invention the total amount of water is in excess of 7.5% wt. water, to about 12.5% wt. water. These various ranges provide for certain flexibilities in the formulation of the compositions each of which ranges exhibit advantageous aspects. Compositions where water does not exceed 1% wt. provide highly concentrated compositions which may diluted in larger quantities of water to form a cleaning composition therefrom without the loss of cleaning efficacy in view of the risk of slight overdilution of the concentrate. Compositions where the total amount of water is no more than 5.5% wt, and especially wherein the total amount of water is in excess of 7.5% wt. water, to about 12.5% wt. are particularly advantageous in that it has surprisingly been found that successful water soluble containers which have a smooth and pliable texture when filled, likely due to the increased amounts of water present in the compositions may be produced, which however exhibit excellent storage stability without leaking of the formed and filled water soluble containers, even under harsh storage conditions (e.g., 120° F.) for 2, 3, 4 weeks and in some instances longer. Such is particularly surprising in compositions which comprise water is in excess of 7.5% wt. water, to about 12.5% wt. as deleterious softening and rupture or leakage of the water soluble container under such harsh temperature conditions would be expected particularly over longer exposure times to such elevated temperature conditions.

Water is not normally necessarily added to the compositions and frequently is provided to the inventive compositions as the aqueous carrier portion of one or more of the constituents used to form a composition. However, where the addition of water is necessary it may be filtered water, but more preferably is distilled or deionized water.

The concentrate compositions of the invention are useful in forming cleaning compositions for the treatment of hard surfaces by dissolving the concentrate composition contained in the water soluble containers in a larger quantity of water to form a cleaning composition therefrom. Most simply the water soluble container containing the concentrate composition is supplied to the larger quantity of water and the water soluble container is allowed to dissolve and thereby release the concentrate composition into the larger quantity of water. The concentrate composition maybe dissolved in any larger quantity of water, and advantageously in respective vol/vol ratios of 1:40, preferably 1:45, more preferably 1:50 and most preferably at least 1:60 parts of the concentrate composition: parts water. A particularly preferred dissolution ratio of the concentrate composition to water is about 15 ml per 800 ml to about 1000 ml water, especially 15 ml concentrate to about 900 ml water. The water used to form the cleaning composition may be tap water, filtered water, distilled water or deionized water. Excellent cleaning results have been observed even in the presence of modest amounts of inorganic salts in the water, e.g., "hard water" used to form a cleaning composition therefrom.

In preferred and especially in most preferred embodiments of the invention the compositions are provide effective cleaning with little or no streaking on hard surfaces, especially glass, or other highly reflective hard surfaces such as glazed tile or polished metal surfaces. This is unattractive to the consumer and usually requires a post application buffing or polishing step by the user of a product. This undesirable characteristic is generally avoided by the compositions of the invention, especially in accordance with preferred embodiments thereof.

EXAMPLES

Preparation of Example Formulations:

Exemplary formulations illustrating certain embodiments of the inventive compositions and described in more detail in Table 1 below were formulated generally by adding the components into a suitably sized vessel in no particular order and at room temperature. If any of the components are solid, thick or gel-like at room temperature, they can be warmed to render them pourable liquids prior to addition to the vessel. Mixing of the constituents was achieved by the use of a mechanical stirrer with a small diameter propeller at the end of its rotating shaft. Mixing, which generally lasted from 5 minutes to 120 minutes was maintained until the particular exemplary formulation appeared to be homogeneous. The exemplary compositions were readily pourable, and retained well mixed characteristics (i.e., stable mixtures) upon standing for extend periods.

Example formulations are listed on Table 1.

TABLE 1

| | Example No. | | | |
|---|---|---|---|---|
| | Ex. 1 | Ex. 2 | Ex. 3 | Ex. 4 |
| Dowanol PnB | 42.00 | 43.00 | 43.00 | 40.00 |
| Dowanol PM | 33.75 | 33.75 | 36.25 | 35.00 |
| Propylene glycol | 14.00 | 14.00 | — | |
| IPA | — | — | 14.80 | 14.80 |
| Emulgen MS-110 | 7.00 | 7.00 | 4.00 | 7.00 |
| MEA | 2.00 | 1.00 | 1.50 | 2.00 |
| Fragrance | 1.25 | 1.25 | 1.25 | 1.20 |
| BHT | — | — | — | 0.01 |
| water | q.s. | q.s. | q.s. | q.s. |

| | Example No. | | | | | | |
|---|---|---|---|---|---|---|---|
| | Ex. 5 | Ex. 6 | Ex. 7 | Ex. 8 | Ex. 9 | Ex. 10 | Ex. 11 |
| Dowanol PnB | 40 | 41.68 | 41.69 | 44.49 | 44.3 | 44.54 | 44.5 |
| IPA | — | — | — | — | — | — | — |
| Dowanol PM | 35 | 35 | 35 | 35 | 35 | 35 | 35 |
| Propylene glycol | 16.75 | 12.5 | 12.5 | 12.5 | 12.5 | 12.5 | 12.5 |

TABLE 1-continued

| | | | | | | | |
|---|---|---|---|---|---|---|---|
| Emulgen MS-110 | 7 | 6.5 | 6.5 | 6.5 | 6.5 | 6.5 | — |
| Biosoft FF-600 | — | — | — | — | — | — | 6.5 |
| MEA | — | — | — | .2 | .4 | — | .3 |
| Fragrance | 1.2 | 1.2 | 1.2 | 1.2 | 1.2 | 1.2 | 1.2 |
| BHT | — | — | — | — | — | — | — |
| Kathon CG | 0.5 | 3 | 3 | — | — | .15 | — |
| Dye | — | .12 | .11 | .11 | .1 | .11 | — |
| water | q.s. | q.s. | q.s. | q.s. | q.s. | q.s. | q.s. |

| | Example No. | | | | | | | | |
|---|---|---|---|---|---|---|---|---|---|
| | Ex. 12 | Ex. 13 | Ex. 14 | Ex. 15 | Ex. 16 | Ex. 17 | Ex. 18 | Ex. 19 | Ex. 20 |
| Dowanol PnB | 44 | 44 | 44.6 | 44.6 | 44.6 | 44.6 | 44.6 | 44.6 | 44.6 |
| IPA | — | — | — | 5 | 5 | 5 | 5 | — | 5 |
| Dowanol PM | 35 | 35 | 35 | 30 | 30 | 30 | 30 | 35 | 30 |
| Propylene glycol | 12.5 | 12.5 | 12.5 | 12.5 | 12.5 | 12.5 | 12.5 | 12.5 | 12.5 |
| Plurafac LF-221 | 7 | — | — | — | — | — | — | — | — |
| Plurafac RA-30 | — | 7 | — | — | — | — | — | — | — |
| Emulgen MS-110 | — | — | — | 4.5 | 4.5 | 6.5 | 6.5 | — | 2 |
| Rewoquat CQ-100 | — | — | 6.5 | 2 | 2 | — | — | — | — |
| Glucopon 425LF | — | — | — | — | — | — | — | 6.5 | 4.5 |
| MEA | .3 | .3 | .2 | .2 | — | .2 | — | .2 | .2 |
| Zonyl FSO | — | — | — | — | — | .03 | .03 | — | — |
| Fragrance | 1.2 | 1.2 | 1.2 | 1.2 | 1.2 | 1.2 | 1.2 | 1.2 | 1.2 |
| Kathon CG | — | — | — | — | .15 | — | .15 | — | — |
| water | q.s. | q.s. | q.s. | q.s. | q.s. | q.s. | q.s. | q.s. | q.s. |

| | Example No. | | | | | | | | |
|---|---|---|---|---|---|---|---|---|---|
| | Ex. 21 | Ex. 22 | Ex. 23 | Ex. 24 | Ex. 25 | Ex. 26 | Ex. 27 | Ex. 28 | Ex. 29 |
| Dowanol PnB | 44.6 | 44.49 | 44.39 | 44.64 | 44.54 | 44.54 | 44.54 | 44.54 | 44.54 |
| Dowanol PM | 30 | 35 | 35 | 35 | 35 | 35 | 35 | 35 | 35 |
| Propylene glycol | 12.5 | 12.5 | 12.5 | 12.5 | 12.5 | 12.5 | 12.5 | 12.5 | 12.5 |
| Ninate 411 | — | — | — | — | — | 2 | 6.5 | — | — |
| Emulgen MS-110 | 4.5 | 4.5 | 4.5 | 4.5 | 4.5 | 4.5 | — | — | 4.5 |
| Rewoquat CQ-100 | 2 | 2 | 2 | 2 | 2 | — | — | — | — |
| Stepantex DA-6 | — | — | — | — | — | — | — | 6.5 | 2 |
| MEA | .2 | .2 | .3 | — | — | .3 | .3 | .3 | .3 |
| NaOH 50% | — | — | — | .05 | — | — | — | — | — |
| Fragrance | 1.2 | 1.2 | 1.2 | 1.2 | 1.2 | 1.2 | 1.2 | 1.2 | 1.2 |
| Kathon CG | — | — | — | — | .15 | — | — | — | — |
| Dye | — | .11 | .11 | .11 | .11 | .11 | .11 | .11 | .11 |
| water | q.s. | q.s. | q.s. | q.s. | q.s. | q.s. | q.s. | q.s. | q.s. |

| | Example No. | | | |
|---|---|---|---|---|
| | Ex. 30 | Ex. 31 | Ex. 32 | Ex. 33 |
| Dowanol PnB | 44.39 | 43.69 | 43.6 | 42.69 |
| Dowanol PM | 35 | 35 | 35 | 35 |
| Propylene glycol | 12.5 | 12.5 | 12.5 | 12.5 |
| Emulgen MS-110 | 4.5 | 4.5 | 4.5 | 4.5 |
| Rewoquat CQ-100 | 2 | 2 | 2 | 2 |
| MEA | 1 | 1 | 2 | 2 |
| Fragrance | — | 1.2 | — | 1.2 |
| Dye | — | .11 | .4 | .11 |
| water | q.s. | q.s. | q.s. | q.s. |

| | Example No. | | | | | | | | |
|---|---|---|---|---|---|---|---|---|---|
| | Ex. 34 | Ex. 35 | Ex. 36 | Ex. 37 | Ex. 38 | Ex. 39 | Ex. 40 | Ex. 41 | Ex. 42 |
| Dowanol PnB | 49.20 | 47.27 | 46.77 | 46.77 | 47.27 | 42.46 | 47.46 | 45.65 | 51.96 |
| Dowanol PM | 35.00 | 35.00 | 35.00 | 35.00 | 35.00 | 35.00 | 35.00 | 35.00 | 36.00 |
| Propylene glycol | 5.00 | 5.00 | 5.00 | 5.00 | 5.00 | 12.50 | 7.50 | 10.00 | — |
| Stepanol WA-100 | 0.50 | — | — | 0.50 | 0.50 | — | — | — | — |
| Emulgen MS-110 | 6.00 | 7.00 | 7.00 | 7.00 | 5.00 | 6.00 | 6.00 | 4.50 | 6.00 |
| Rewoquat CQ-100 | 2.00 | 3.00 | 4.00 | 4.00 | 5.00 | 2.00 | 2.00 | 2.00 | — |
| Tomah AO-14-2 | — | — | — | — | — | — | — | — | 2.00 |
| Tomah Q-17-2 | — | — | — | — | — | — | — | — | 2.00 |
| Zonyl FSO | — | — | — | — | — | — | — | 1.00 | — |
| MEA | 1.00 | 1.00 | 1.00 | 1.00 | 1.00 | 1.00 | 1.00 | 1.00 | 1.00 |

TABLE 1-continued

| | | | | | | | | | |
|---|---|---|---|---|---|---|---|---|---|
| Fragrance | 1.20 | 1.20 | 1.20 | 1.20 | 1.20 | 1.00 | 1.00 | 1.00 | 1.00 |
| Dye | 0.10 | 0.03 | 0.03 | 0.03 | 0.03 | 0.035 | 0.035 | 0.035 | 0.035 |
| water | q.s. | q.s. | q.s. | q.s. | q.s. | q.s. | q.s. | q.s. | q.s. |

| | Example No. | | | | | | | | |
|---|---|---|---|---|---|---|---|---|---|
| | Ex. 43 | Ex. 44 | Ex. 45 | Ex. 46 | Ex. 47 | Ex. 48 | Ex. 49 | Ex. 50 | Ex. 51 |
| Dowanol PnB | 44.45 | 44.46 | 42.46 | 43.96 | 43.96 | 42.96 | 43.00 | 43.40 | 49.00 |
| Dowanol PM | 35.00 | 35.00 | 35.00 | 35.00 | 35.00 | 35.00 | 35.00 | 35.00 | 35.00 |
| Propylene glycol | 10.00 | 12.50 | 12.50 | 12.50 | 12.50 | 12.50 | 12.50 | 12.5 | — |
| Stepanol WA-100 | — | — | — | — | — | 1.00 | — | 0.60 | 5.00 |
| Emulgen MS-110 | 4.50 | 4.00 | 4.00 | 4.50 | — | — | — | — | — |
| Rewoquat CQ-100 | 2.00 | — | 2.00 | 2.00 | 2.00 | 2.00 | 2.00 | 2.00 | — |
| Tomah AO-14-2 | 2.00 | — | — | — | — | — | — | — | — |
| Tomah Q-17-2 | — | — | — | — | — | — | — | — | — |
| Dowfax 3B2 | — | 2.00 | 2.00 | — | — | — | — | — | — |
| Dowfax C10L | — | — | — | — | — | — | 1.00 | 2.00 | — |
| Glucopon 325 NP | — | — | — | — | 4.00 | 4.00 | — | 2.00 | 8.00 |
| Plurafac SLF-18 | — | — | — | — | — | — | — | — | 1.00 |
| MEA | 1.00 | 1.00 | 1.00 | 1.00 | 1.00 | 1.00 | 1.00 | 1.00 | 1.00 |
| Fragrance | 1.00 | 1.00 | 1.00 | 1.00 | 1.00 | 1.00 | 1.00 | 1.00 | 1.00 |
| Dye | 0.035 | 0.035 | 0.035 | 0.035 | — | — | — | — | — |
| water | q.s. | q.s. | q.s. | q.s. | q.s. | q.s. | q.s. | q.s. | q.s. |

| | Example No. | | | | | | | | |
|---|---|---|---|---|---|---|---|---|---|
| | Ex. 52 | Ex. 53 | Ex. 54 | Ex. 55 | Ex. 56 | Ex. 57 | Ex. 58 | Ex. 59 | Ex. 60 |
| Dowanol PnB | 44.94 | 34.44 | 32.00 | 33.04 | 33.04 | 32.00 | 31.00 | 33.40 | 32.40 |
| Dowanol PM | 35.00 | 32.00 | 31.64 | 32.00 | 32.00 | 30.54 | 29.04 | 32.00 | 32.00 |
| Propylene glycol | — | 12.50 | 16.00 | 14.00 | 11.50 | 14.00 | 13.00 | 14.00 | 14.00 |
| Stepanol WA-100 | 4.00 | 4.00 | 4.00 | 4.00 | 4.00 | 4.00 | — | 4.00 | 4.00 |
| Stepanol WAC | — | — | — | — | — | — | 10.00 | — | — |
| Glucopon 325 NP | 8.00 | — | — | — | — | — | — | — | — |
| Glucopon 325 NK | — | 8.00 | 8.00 | 8.00 | 8.00 | 8.00 | 8.00 | 8.00 | 8.00 |
| Plurafac CS-1 | — | — | — | — | — | — | — | 1.00 | 1.00 |
| Steol CS-330 | 6.00 | — | — | — | — | — | — | — | — |
| Steol CS-460 | — | 6.00 | 6.00 | 6.00 | 6.00 | 6.00 | 6.00 | 6.00 | 6.00 |
| MEA | 1.00 | 1.00 | 1.30 | 1.30 | 1.30 | 1.30 | 1.30 | 1.00 | 1.00 |
| Fragrance | 1.00 | 1.00 | 1.00 | 1.00 | 1.00 | 1.00 | 1.00 | — | 1.00 |
| Dye | 0.06 | 0.06 | 0.06 | 0.06 | 0.06 | 0.06 | 0.06 | — | — |
| Dantogard Plus liquid | — | — | — | 0.60 | 0.60 | 0.60 | 0.60 | 0.60 | 0.60 |
| water | q.s. | q.s. | q.s. | q.s. | q.s. | q.s. | q.s. | q.s. | q.s. |

| | Example No. | | | | | |
|---|---|---|---|---|---|---|
| | Ex. 61 | Ex. 62 | Ex. 63 | Ex. 64 | Ex. 65 | Ex. 66 |
| Dowanol PnB | 34.40 | 34.40 | 36.80 | 42.46 | 49.25 | 44.94 |
| Dowanol PM | 32.00 | 32.00 | 33.00 | 35.00 | 35.00 | 35.00 |
| Propylene glycol | 14.00 | 14.00 | 12.00 | 12.50 | 5.00 | — |
| Stepanol WA-100 | 2.00 | — | 4.00 | — | 0.50 | 4.00 |
| Stepanol WAC | — | — | — | — | — | — |
| Glucopon 325 NP | — | — | — | — | — | 8.00 |
| Glucopon 325 NK | 8.00 | 8.00 | — | — | — | — |
| Glucopon 225 DK | — | — | 5.60 | — | — | — |
| Plurafac CS-1 | 1.00 | 1.00 | — | — | — | — |
| Steol CS-330 | — | — | — | — | — | — |
| Steol CS-460 | 6.00 | 8.00 | 6.00 | — | — | 6.00 |
| Rewoquat CQ-100 | — | — | — | 2.00 | 2.00 | — |
| Emulgen MS-110 | — | — | — | 6.00 | 6.00 | — |

TABLE 1-continued

| | | | | | | |
|---|---|---|---|---|---|---|
| MEA | 1.00 | 1.00 | 1.00 | 1.00 | 1.00 | 1.00 |
| Fragrance | — | — | — | 1.00 | 1.20 | 1.00 |
| Dye | — | — | — | 0.035 | 0.05 | 0.06 |
| Dantogard Plus liquid | 0.60 | 0.60 | 0.60 | — | — | — |
| water | q.s. | q.s. | q.s. | q.s. | q.s. | q.s. |

The above formulations are then placed into either thermoformed or injection molded water-soluble containers using the methods described above. The water soluble containers showed very little or no migration of liquid.

The components of the compositions set forth in the above Table 1 are described in Table 2 below. The indicated weight percentages listed on Table 1 are based on the identified component "as supplied", while Table 2 lists the component, its generic chemical name, the percent weight actives shown in parenthesis (if not 100% wt. actives), and where available, the supply source of the as supplied component.

TABLE 2

| Component | |
|---|---|
| Stepanol WAC | anionic sodium lauryl sulfate (29% active) ex. Stepan |
| Stepanol WA-100 | anionic sodium lauryl sulfate (95% active) ex.Stepan |
| Steol CS-330 | anionic sodium lauryl ether sulfate (27.5%-29.5% active) |
| Steol CS-460 | anionic sodium lauryl ether sulfate (60% active) |
| Ninate 411 | anionic isopropyl amine alkylbenzene sulfonate (90% active) ex. Stepan |
| Dowfax 3B2 | anionic dodecyl dibenzene disulfonate (50% active) ex. Dow |
| Dowfax C10L | anionic sodium decyl diphenyloxide disulfonate (45% active) ex. Dow |
| Plurafac CS-1 | anionic polycarboxylated alkoxylated alcohol (50% active) |
| Alpha step MC48 | sodium alphasulfo methyl $C_{12-18}$ ester and disodium alphasulfo $C_{12-18}$ fatty acid salt (37% active) ex. Stepan |
| Rewoquat CQ-100 | mixture of ethoxylated cocoalkyl methyl quaternary ammonium chlorides and ethoxylated fatty alcohols (100% active) ex. Degussa |
| Neodol 91-6 | non-ionic $C_9$-$C_{11}$ ethoxylated alcohol having about 6 ethoxy groups per molecule (100% active) ex. Shell |
| Neodol 91-8 | non-ionic $C_9$-$C_{11}$ ethoxylated alcohol having about 8 ethoxy groups per molecule (100% active) ex. Shell |
| Emulgen MS-110 | non-ionic $C_{12}$-$C_{14}$(EO/PO/EO) surfactant (100% active) ex. Kao |
| Biosoft FF-600 | non-ionic $C_{6-10}$ alcohol ethoxylate (4EO) ex. Stepan |
| APG 325N | non-ionic alkyl polyglycoside (50% active) ex. Clariant |
| Glucopon 225 DK | non-ionic alkyl polyglycoside (70% active) ex. Clariant |
| Glucopon 325 NK | non-ionic alkyl polyglycoside (50% active) ex. Clariant |
| Glucopon 325 NP | non-ionic alkyl polyglycoside (50% active) ex. Clariant |
| Glucopon 425LF | non-ionic alkyl polyglycoside (50% active) ex. Clariant |
| Plurafac LF-221 | non-ionic linear alcohol alkoxylate (100% active) ex. BASF |
| Plurafac RA-30 | non-ionic alkoxylated $C_{12}$-$C_{15}$ alcohol (100% active) ex. BASF |
| Plurafac SLF-18 | non-ionic alkoxylated $C_6$-$C_{10}$ alcohol, comprising both ethoxy and propoxy groups (100% active) ex. BASF |
| Stepantex DA-6 | non-ionic isodecyl alcohol ethoxylate (100% active) ex. Stepan |
| Tomah AO-14-2 | non-ionic dihydroxyethylisodecyloxypropylamine oxide (30% active) |
| Tomah Q-17-2 | cationic methyl dihydroxyethylisotridecyloxypropyl ammonium chloride (30% active) |
| IPA | isopropanol (100% active) |
| Dowanol PnB | propylene glycol n-butyl ether; (100% active) ex. Dow |
| Dowanol PM | propylene glycol methyl ether; (100% active) ex. Dow |
| Propylene glycol | propylene glycol (100% active) |
| Dowanol DPnB | dipropylene glycol n-butyl ether (100% active) (Dow) |
| MEA | monoethanolamine, (100% active) |
| Fragrance | fragrance (proprietary composition) |
| Dye | dye (proprietary composition) |
| BHT | butylated hydroxytoluene, an antioxidant (100% active) |
| NaOH | sodium hydroxide (50% actives) |
| Kathon CG | methylchloroisothiazolinone/methylisothiazolinone (preservative) (1.5% Active) ex. Rohm & Haas |
| Zonyl FSO | ethoxylated fluorinated cationic surfactant (30% active) ex. DuPont |

In use, a water soluble container can be placed into a spray bottle which uses a dip tube and trigger assembly to dispense a liquid, an amount of water (usually from about 16 to 32 ounces, depending upon the bottle and size of the water soluble container) is added to the bottle wherein the water soluble container starts to dissolve. The dip tube with trigger assembly is then reattached to the bottle and the solution formed therein is ready for us. The resulting solution can be used to treat a variety of surfaces, examples of which are described above. In addition, the water soluble container can also be used in conjunction with cleaning systems which comprise a handle, a cleaning head, and a fluid reservoir wherein the fluid reservoir is attached to the handle such that the fluid in the reservoir is dispensed onto a surface to be cleaned adjacent to the cleaning head. In use, the water soluble container is placed into the fluid reservoir, the requisite amount of water is added to the reservoir and the water soluble container dissolves, releasing the composition contained therein to be released into the reservoir. The resulting solution is then ready to use in the cleaning system. Examples of cleaning systems include those described in, for example, WO 01/72195; WO 01/22861; WO 00/27271; WO 98/42246; DE 3940123; and U.S. Pat. No. 5,888,006, the contents of which are incorporated by reference.

Particularly preferred compositions of the present invention will have good cleaning properties and will not leave streaks on shiny surfaces, such as glass and mirrors.

Cleaning Evaluation

The cleaning characteristics of certain example formulations described on Table 1 were evaluated.

Cleaning evaluations were also performed in accordance with the testing protocol outlined according to ASTM D4488 A2 Test Method, which evaluated the efficacy of the cleaning compositions on masonite wallboard samples painted with wall paint. The soil applied was a greasy soil sample containing vegetable oil, food shortening and animal fat. The sponge (water dampened) of a Gardner Abrasion Tester apparatus was squirted with a 15 gram sample of a tested cleaning composition, diluted in water at a vol/vol ratio of composition:water of 15 grams (15 ml):950 grams (950 ml) "hard water" (tap water from a municipal water source in Montvale, N.J.) and the apparatus was cycled 10 times. The evaluation of cleaning compositions was "paired" with one side of each of the test samples treated with a composition according to the invention as described on Table 1, and the other side of the same sample treated with a commercially available comparative composition (Glass Plus® window cleaning composition designated as "GB" on Table 3, ex. Reckitt Benckiser, as supplied and requiring no further dilution) thus allowing a "side-by-side" comparison to be made. The cleaning efficacy of the tested compositions was evaluated utilizing a Minolta Chroma Meter CF-110, with Data Processor DP-100, which evaluated spectrophotomic characteristics of the sample, with the % soil removal calculated according to the to ASTM D4488 A2 Test Method. The results are reported on Table 3 following.

TABLE 3

| Tile # | Comp: | % soil removal | Tile # | Comp: | % soil removal | Tile # | Comp: | % soil removal | Tile # | Comp: | % soil removal |
|---|---|---|---|---|---|---|---|---|---|---|---|
| 1 | Ex. 65 | 55.89 | 1 | Ex. 64 | 32.40 | 1 | Ex. 66 | 53.14 | 1 | Ex. 55 | 43.28 |
| 1 | GP | 58.41 | 1 | GP | 50.19 | 1 | GP | 42.98 | 1 | GP | 46.59 |
| 2 | Ex. 65 | 72.81 | 2 | Ex. 64 | 44.96 | 2 | Ex. 66 | 53.46 | 2 | Ex. 55 | 47.94 |
| 2 | GP | 71.43 | 2 | GP | 50.04 | 2 | GP | 45.21 | 2 | GP | 54.99 |
| 3 | Ex. 65 | 57.54 | 3 | Ex. 64 | 21.21 | 3 | Ex. 66 | 43.92 | 3 | Ex. 55 | 51.02 |
| 3 | GP | 54.48 | 3 | GP | 27.93 | 3 | GP | 52.68 | 3 | GP | 51.86 |
| 4 | Ex. 65 | 42.46 | 4 | Ex. 64 | 21.74 | 4 | Ex. 66 | 42.68 | 4 | Ex. 55 | 42.11 |
| 4 | GP | 41.42 | 4 | GP | 47.22 | 4 | GP | 43.10 | 4 | GP | 50.44 |
| 5 | Ex. 65 | 37.22 | 5 | Ex. 64 | 29.33 | 5 | Ex. 66 | 38.63 | 5 | Ex. 55 | 49.77 |
| 5 | GP | 32.03 | 5 | GP | 51.00 | 5 | GP | 46.52 | 5 | GP | 49.70 |
| 6 | Ex. 65 | 71.53 | 6 | Ex. 64 | 41.70 | 6 | Ex. 66 | 50.20 | 6 | Ex. 55 | 31.43 |
| 6 | GP | 69.26 | 6 | GP | 52.51 | 6 | GP | 46.52 | 6 | GP | 33.83 |
| 7 | Ex. 65 | 71.39 | 7 | Ex. 64 | 66.71 | 7 | Ex. 66 | 53.25 | 7 | Ex. 55 | 65.09 |
| 7 | GP | 71.66 | 7 | GP | 69.68 | 7 | GP | 54.53 | 7 | GP | 67.60 |
| 8 | Ex. 65 | 48.36 | 8 | Ex. 64 | 50.70 | 8 | Ex. 66 | 52.90 | 8 | Ex. 55 | 41.38 |
| 8 | GP | 46.10 | 8 | GP | 56.59 | 8 | GP | 57.10 | 8 | GP | 44.82 |
| 9 | Ex. 65 | 47.77 | 9 | Ex. 64 | 62.05 | 9 | Ex. 66 | 56.49 | 9 | Ex. 55 | 25.86 |
| 9 | GP | 51.55 | 9 | GP | 64.12 | 9 | GP | 47.86 | 9 | GP | 29.18 |
| 10 | Ex. 65 | 49.48 | 10 | Ex. 64 | 18.68 | 10 | Ex. 66 | 52.63 | 10 | Ex. 55 | 43.92 |
| 10 | GP | 57.41 | 10 | GP | 17.97 | 10 | GP | 57.65 | 10 | GP | 45.83 |
| | | | | | | 11 | Ex. 66 | 42.83 | | | |
| | | | | | | 11 | Ex. 66 | 40.60 | | | |
| | | | | | | 12 | Ex. 66 | 37.44 | | | |
| | | | | | | 12 | GP | 38.88 | | | |

As can be seen from the results of the foregoing Table 3, the cleaning efficacy of aqueous dilutions of the composition according to the invention provided comparable results over those of known art cleaning products.

Storage Stability

The storage stability of the inventive compositions were evaluated for both a concentrate composition contained in a PVOH film as described on Table 1 as well as for an aqueous dilution of the same concentrate composition diluted diluted in water at a vol/vol ratio of composition:water of 15 grams (15 ml):950 grams (950 ml) "hard water" (tap water from a municipal water source in Montvale, NJ). These two compositions were evaluated for their freeze-thaw stability (3 cycles), as well as storage stability for up to 6 weeks at room temperature (68° F., 20° C.), 40° F., 105° F. (at a relative humidity of 80%) and 120° F.

The results of the storage stability evaluation of the concentrate composition according to Example 55 of Table 1 contained in a PVOH film are disclosed on Table 4A, whilst the storage stability evaluation of the diluted concentrate composition according to Example 55 of Table 1 are disclosed on Table 4B.

TABLE 4A

| | | (concentrate) | | |
|---|---|---|---|---|
| | | pH | Color | Appearance |
| | initial | 11.4 | Blue | dual phase |
| Freeze/Thaw | cycle 1 | 11.37 | 5 | ok |
| | cycle 2 | 11.35 | 5 | ok |
| | cycle 3 | 11.35 | 5 | ok |
| room | week 1 | 11.39 | 5 | ok |
| temperature | week 2 | 11.35 | 4.5 | ok |
| | week 4 | 11.33 | 4.5 | ok |
| | week 6 | 11.32 | 4.5 | ok |
| 40° F. | week 1 | 11.35 | 5 | ok |
| | week 2 | 11.39 | 5 | ok |
| | week 4 | 11.35 | 5 | ok |
| | week 6 | 11.37 | 5 | ok |
| 105° F. | week 1 | 11.40 | 5 | ok |
| | week 2 | 11.39 | 4.5 | ok |
| | week 4 | 11.35 | 4 | ok |
| | week 6 | 11.35 | 4 | ok |
| 120° F. | week 1 | 11.37 | 5 | ok |
| | week 2 | 11.35 | 4.5 | ok |
| | week 4 | 11.34 | 4 | ok |
| | week 6 | 11.31 | 4 | ok |

5 = Excellent. No noticeable color change or fading
4 = Good. No noticeable color change but slight fading
3 = Acceptable. Very slight color change and slight fading
2 = Not Acceptable. Color changed and/or color faded The evaluation of the color of the concentrate composition described with reference to Table 4A was according to the foregoing scale.

Each of the tested compositions in contained in a PVOH film used to generate the results indicated on Table 4A was subsequently provided to a larger quantity of water and it was observed that the compositions and the PVOH film readily dissolved to form a useful cleaning composition.

TABLE 4B

| | | pH | Color | Appearance |
|---|---|---|---|---|
| | initial | 9.45 | Blue | Clear |
| Freeze/Thaw | cycle 1 | 9.45 | 5 | ok |
| | cycle 2 | 9.41 | 5 | ok |
| | cycle 3 | 9.40 | 5 | ok |
| room | week 1 | 9.42 | 5 | ok |
| temperature | week 2 | 9.39 | 4.5 | ok |
| | week 4 | 9.42 | 4.5 | ok |
| | week 6 | 9.42 | 4.5 | |
| 40° F. | week 1 | 9.45 | 5 | ok |
| | week 2 | 9.43 | 5 | ok |
| | week 4 | 9.43 | 5 | ok |
| | week 6 | 9.43 | 4.5 | ok |
| 105° F. | week 1 | 9.38 | 5 | ok |
| | week 2 | 9.38 | 4.5 | ok |
| | week 4 | 9.37 | 4 | ok |
| | week 6 | 9.39 | 4 | |
| 120° F. | week 1 | 9.41 | 4.5 | ok |
| | week 2 | 9.41 | 4 | ok |
| | week 4 | 9.42 | 4 | ok |
| | week 6 | 9.40 | 4 | ok |

The evaluation of the color of the concentrate composition described with reference to Table 4B was according to the same scale as Table 4A.

The invention claimed is:

1. A water soluble container enclosing a concentrate composition consisting of:

(a) at least one surfactant which is either:

(i) a $C_{10}$-$C_{14}$ alkyl sulfate surfactant, a $C_{10}$-$C_{14}$ alkyl ether sulfate surfactant or mixture thereof, further in conjunction with one or more nonionic alkylpolyglycoside surfactants, or (ii) at least one nonionic surfactant based on an ethoxy/propoxy block copolymer, further in conjunction with at least one nonionic surfactant based on an ethoxylated fatty alcohol;

(b) at least 70% wt. of at least one organic solvent having a solubility in water of at least 4% wt. selected from the group consisting of propylene glycol n-butyl ether, propylene glycol methyl ether, and mixtures thereof, and optionally a $C_1$-$C_6$ glycol or a $C_1$-$C_6$ monohydric alcohol;

(c) in excess of 7.5% wt. water, but no more than 12.5% wt. water;

(d) optionally, at least one alkanolamine; and (e) optionally, up to about 10% wt. of one or more conventional additives selected from coloring agents, fragrances and fragrance solubilizers, further surfactants, pH adjusting agents and pH buffers, optical brighteners, opacifying agents, hydrotropes, anti-oxidants, and preservatives.

2. A water soluble container enclosing a concentrate composition according to claim 1 wherein the at least one alkanolamine is present in the composition.

3. A water soluble container enclosing a concentrate composition according to claim 1 wherein the concentrate composition exhibits a flash point of at least 105° F.

4. A water soluble container enclosing a concentrate composition according to claim 1 wherein the $C_1$-$C_6$ glycol, or the $C_1$-$C_6$ monohydric alcohol is present in the composition.

5. A water soluble container enclosing a concentrate composition according to claim 4 wherein the organic solvent consists of propylene glycol n-butyl ether, propylene glycol methyl ether and a $C_1$-$C_6$ monohydric alcohol.

6. A water soluble container enclosing a concentrate composition according to claim 4 wherein the organic solvent consists of propylene glycol n-butyl ether, propylene glycol methyl ether and a $C_1$-$C_6$ glycol.

7. A water soluble container enclosing a concentrate composition according to claim 1 wherein the (e) further surfactant is an alkoxylated quaternary ammonium compound.

8. The water soluble container according to claim 1 which is a thermoformed or injection molded water soluble polymer.

9. The water soluble container according to claim 8 wherein the water soluble polymer is poly(vinyl alcohol).

10. A water soluble container enclosing a concentrate composition according claim 1 wherein the (b) the at least one organic solvent having a solubility in water of at least 4% wt. is present in an amount of at least 75% wt.

11. A water soluble container enclosing a concentrate composition according to claim 1, characterized in that when said water soluble container and concentrate composition are dissolved in a larger quantity of water to form a cleaning composition therefrom, said cleaning composition exhibits low streaking characteristics when used to clean polished hard surfaces selected from the group consisting of: polished metal surfaces, glass, and mirrors.

12. A process for treating a surface, particularly a hard surface especially one or more selected from polished metal surfaces, glass and mirrors in need of cleaning, comprising the process steps of:

placing a water soluble container containing a concentrate composition according to claim 1 into a larger quantity of water;

allowing the water soluble container to dissolve in the water to form a cleaning solution;

and applying an effective amount of the solution to the surface in need of treatment.

* * * * *